US005740586A

United States Patent [19]

Gomas

[11] Patent Number: 5,740,586

[45] Date of Patent: Apr. 21, 1998

[54] TOOL HANDLE

[75] Inventor: Herve Gomas, Evry, France

[73] Assignee: Facom, Morangis Cedex, France

[21] Appl. No.: 495,637

[22] PCT Filed: Jan. 3, 1995

[86] PCT No.: PCT/FR95/00003

§ 371 Date: Aug. 4, 1995

§ 102(e) Date: Aug. 4, 1995

[87] PCT Pub. No.: WO95/18701

PCT Pub. Date: Jul. 13, 1995

[30] Foreign Application Priority Data

Jan. 11, 1994 [FR] France ..... 94 00217

[51] Int. Cl.[6] ..... A47B 95/02

[52] U.S. Cl. ..... 16/111 R; 16/DIG. 12; 81/177.1

[58] Field of Search ..... 16/111 R, 110 R, 16/DIG. 12; 81/436, 489, 177.1, 900, 116 R

[56] References Cited

U.S. PATENT DOCUMENTS

| | | | |
|---|---|---|---|
| 264,527 | 9/1882 | Haley | 81/489 |
| 2,520,808 | 8/1950 | Miller | 16/111 R |
| 2,871,899 | 2/1959 | Coyle et al. . | |
| 4,452,289 | 6/1984 | Smith . | |
| 4,729,271 | 3/1988 | Kenigson | 81/177.1 |
| 4,837,892 | 6/1989 | Lo | 16/111 R |
| 5,107,590 | 4/1992 | Burout, III et al. . | |

FOREIGN PATENT DOCUMENTS

| | | |
|---|---|---|
| 0 513 459 | 11/1992 | European Pat. Off. . |
| 2 636 557 | 3/1990 | France . |
| 91 12 630.4 | 1/1992 | Germany . |
| 92 02 550.1 | 6/1992 | Germany . |
| 93/25354 | 12/1993 | WIPO . |

*Primary Examiner*—Chuck Y. Mah

*Attorney, Agent, or Firm*—Wenderoth, Lind & Ponack

[57] ABSTRACT

A two-material or three-material tool handle includes, over at least part of its length, an outer sheath made of a flexible grade polyester elastomer overmolded onto a carrier sleeve made of a hart grade polyester elastomer.

21 Claims, 2 Drawing Sheets

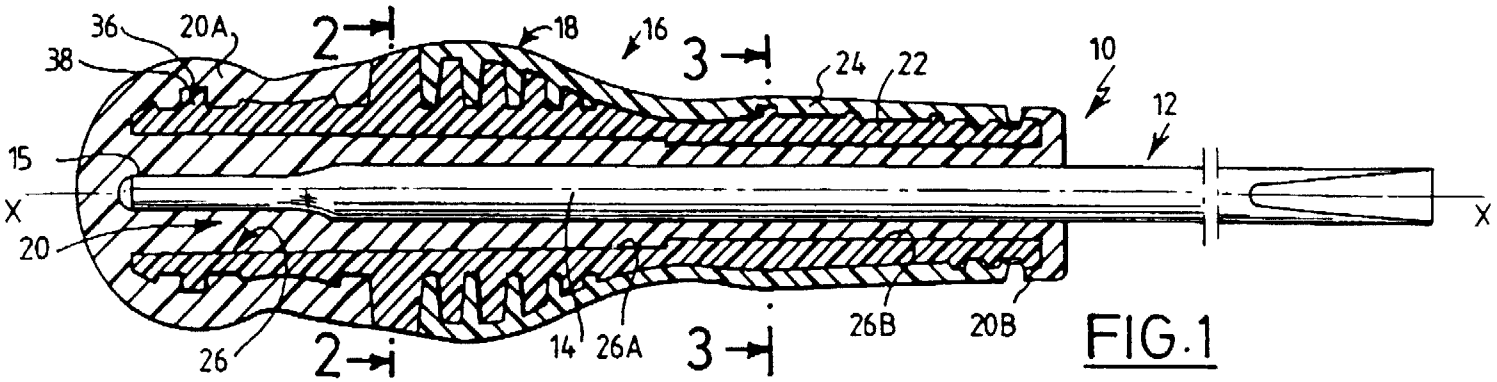
FIG. 1
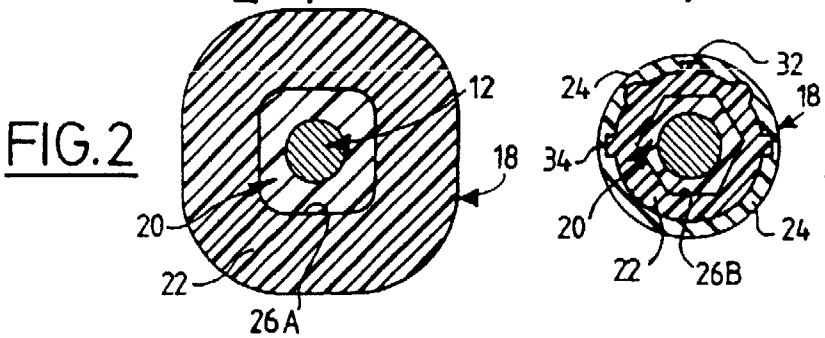
FIG. 2
FIG. 3
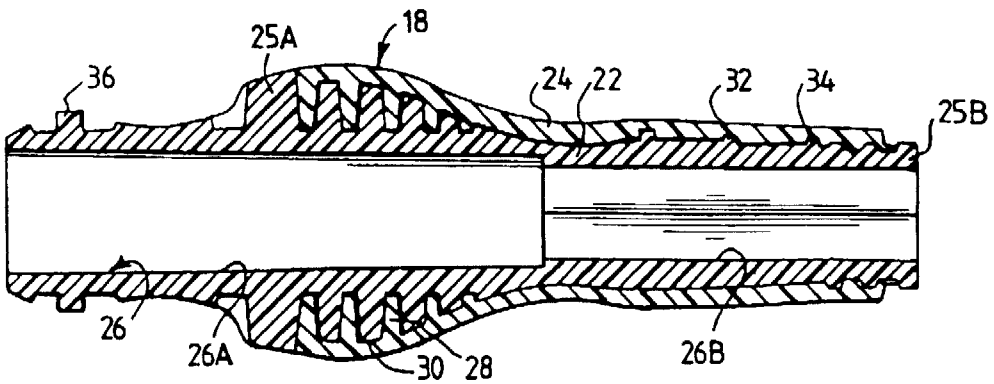
FIG. 4

TOOL HANDLE

BACKGROUND OF THE INVENTION

The present invention relates to a tool handle, of the type including at least two plastics and comprising, over at least part of its length, an outer sheath made of a relatively flexible plastic.

The invention applies to various hand tools such as pliers, screwdrivers, etc.

The handles of tools of the above type have the advantage of offering the user a feel which is both non-slip and strong and which allows substantial forces to be exerted very comfortably.

However, the technology for producing these tool handles is tricky, because it has to be capable, at low cost, of providing excellent integrity of the outer sheath over time, despite its frequent exposure to aggressive mediums such as car fuel, white spirit, trichloroethane and other aromatic substances. Furthermore, the handle must be resistant to clamping forces and possibly to torques.

Presently, current solutions do not simultaneously provide resistance to forces, integrity against aggressive mediums, and a relatively soft feel of the outer surface.

SUMMARY OF THE INVENTION

In order to solve this problem, the invention proposes a tool handle of the aforementioned type, wherein the outer sheath essentially consists of a flexible grade polyester elastomer and is overmolded onto a carrier sleeve consisting of a material based on a hard grade polyester elastomer.

The carrier sleeve may essentially consist of a hard grade polyester elastomer.

The outer sheath may consist of a practically pure polyester elastomer, and the same my be true of the carrier sleeve.

In some cases, especially for covering the handles of pliers, the carrier sleeve may be directly in contact with the underlying metal part of the tool, to which it is securely attached by friction and/or by matching of mating shapes.

In other cases, where the tool handle is intended to transmit substantial torque, especially for covering a screwdriver blade, the carrier sleeve may surround an essentially tubular connecting element consisting of a third plastic which is harder than the plastic of the carrier sleeve and connected to the underlying metal part of the tool by friction and/or by matching of mating shapes.

The connecting element may then be overmolded in the carrier sleeve.

BRIEF DESCRIPTION OF THE DRAWINGS

Embodiments of the invention will now be described with reference to the appended drawings, in which:

FIG. 1 is a longitudinal section through a screwdriver equipped with a three-material handle according to the invention;

FIG. 2 is a section on 2—2 of FIG. 1;

FIG. 3 is a section on 3—3 of FIG. 1;

FIG. 4 is a longitudinal section through a two-material sleeve used information of the screwdriver handle of FIG. 1.

DETAILED DESCRIPTION OF THE INVENTION

Figure 5:
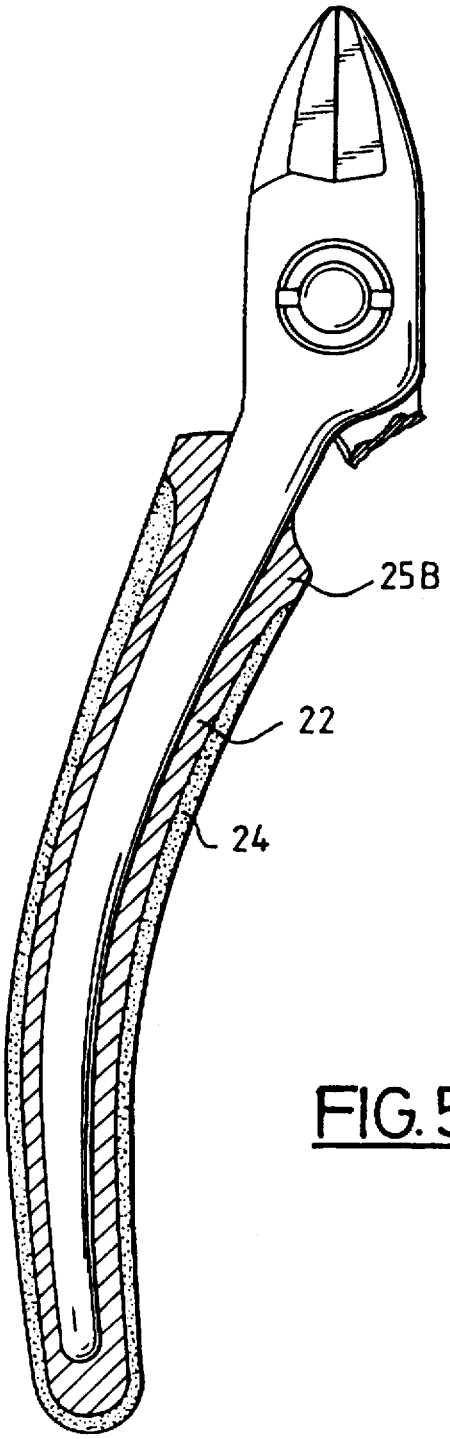
FIG. 5 is a partially sectioned part view of side cutters, each handle of which is equipped with a two-material sleeve in accordance with the invention.

The screwdriver 10 represented in FIG. 1, with overall axis X—X assumed horizontal, includes a metal shaft 12 forming a blade equipped with a handle-receiving portion or end 14 set into a handle 16 made of three plastic materials according to a first embodiment of the invention.

In the conventional way, the set-in end 14 of the blade 12 includes a flattened extremity 15 intended to reinforce the immobilization of the blade 12 in terms of it rotating about its axis.

The handle 16 comprises a sleeve 18 surrounding a connecting element 20 into which the blade 12 is set.

The sleeve 18 comprises two coaxial tubular parts, namely an inner carrier sleeve 22 and an outer sheath 24, made of different plastics. More precisely, the carrier sleeve 22 consists of a hard grade polyester elastomer (hardness 72 Shore D), while the sheath 24 consists of a flexible grade polyester elastomer (hardness 35 Shore D) overmolded onto the carrier sleeve.

The elastomers in question may be practically pure. The flexible grade elastomer may incorporate inorganic fillers, particularly colorants and/or rheological agents. The pure grade elastomer may more widely incorporate various additives: fibers, inorganic fillers, glass beads, blowing agents, plasticizers, etc.

As far as the connecting element 20 is concerned, it consists of a plastic which is markedly harder than the plastic of the carrier sleeve 22, for example a cellulose acetate, a polyamide, a rigid polyester or made of polyacetal.

The sheath 24 extends over approximately the front half of the length of the carrier sleeve between an annular ring 25A projecting from the latter and a front extremity collar 25B of the carrier sleeve. The connecting element 20 occupies the space between the carrier sleeve and the blade 12 and includes a rear extremity 20A which covers the whole of the rear part of the carrier sleeve, as far as the rear face of the ring 25A, as well as a front extremity 20B which covers over the collar 25B.

The sleeve 18 includes an internal surface 26 designed to secure the sleeve 18 to the connecting part 20 in an optimum fashion. For example, as can be seen particularly in FIGS. 2 and 3, the internal surface 26 of the sleeve 18 is delimited by a first part 26A of substantially polygonal, preferably square, transverse section extending from the free extremity of the handle 16 as far as a second part 26B of this internal surface, of substantially polygonal, preferably hexagonal, transverse section, and having a perimeter smaller than that of the transverse section of the first part 26A.

As an alternative, the internal surface of the sleeve 18 may have varied, constant or otherwise, sections.

The method for manufacturing the handle 16 of the screwdriver represented in FIG. 1 will now be described.

Initially, the two-material sleeve 18 as represented in FIG. 4 is manufactured by injection-molding the carrier sleeve 22 and using injection molding to overmold the sheath 24 onto it.

The overmolding of the sheath 24 onto the carrier sleeve 22 is carried out in such a way as to leave the extremities of the carrier sleeve 22 free.

In order to promote the fastening of the sheath 24 onto the carrier sleeve 22, these two parts are molded so as to form complementary projections and recesses 28 to 34 on their contacting surfaces.

In order to manufacture the sleeve 18, use is made, for example, of a conventional molding press with two injection heads (1 head per substance to be injected).

After the sleeve 18 has been manufactured, the inset end 14 of the blade 12 is placed inside the sleeve 18, coaxial with the latter. Then the connecting element 20 is injection-molded between the blade 12 and the sleeve 18 so that the sleeve 18/connecting element 20 assembly forms the handle 16 of the screwdriver represented in FIG 1.

The molding of the connecting part 20 is carried out so as to overmold the extensions 20A, 20B thereof, external to the sleeve 18, onto the extremities of the sleeve.

Complementary fastening projections and recesses 36, 38 are formed directly from molding of the contacting surfaces of the external extension 20A of the connecting element 20, delimiting the free or rear extremity of the handle 16, and of the corresponding extremity of the sleeve 18.

The molding of the connecting part 20 is carried out, for example, using a conventional molding press with one injection head.

As an alternative, the extremity of the set-in end 14 of the blade may come flush with the free extremity of the handle or extend beyond this extremity. In this case, it is possible to cover the flush extremity of the set-in end with a plug fixed to the free extremity of the handle by known means.

Of course, the manufacture of the sleeve 18 and the molding of the connecting part 20 may be carried out at different sites.

By virtue of the use of the plastics indicated earlier, the sheath 24 is fastened closely and strongly, upon overmolding thereof, onto the carrier sleeve 22, by virtue of the affinity of the two polyester elastomers, and this fastening remains even after protracted exposure to aggressive agents such as aromatic substances. Furthermore, since the hard grade elastomer forming the carrier sleeve is not particularly sensitive to these agents, its fastening, which is practically entirely mechanical, using friction and the matching of mating shapes, to the connecting element 20 is reliable and permanent. The hard plastics used for this connecting element, such as those indicated earlier, moreover have a substantial advantage in their low cost.

When it is not necessary to transmit high torque, the structure of the sleeve may be simplified by dispensing with the connecting element.

Thus, in the case of side cutters (FIG. 5), the carrier sleeve 22 has the shape of a sock with a front extremity collar 25B, and the sheath 24 also has the shape of a sock, which covers the whole of the carrier sleeve as far as the rear face of this collar 25B.

As with the case of the screwdriver handle of FIGS. 1 to 4, the mutual affinity of the two polyester elastomers gives close and very strong fastening between these two parts of the handle, upon overmolding of the sheath onto the carrier sleeve, and this fastening is resistant to aromatic agents.

Furthermore, the carrier sleeve is reliably fastened to the metal handle of the pliers merely by friction and/or the matching of mating shapes (which are conventional and not represented). This results from the very slight stress relaxation, over time, of hard-grade polyester elastomers, and from the fact that they are almost insensitive to aromatic agents.

I claim:

1. A tool handle to be applied over a portion of a tool, said tool handle comprising, over at least part of a length thereof:

a carrier sleeve to be positioned about the tool portion, said carrier sleeve consisting of a material based on a hard grade polyester elastomer; and an outer sheath fixed to said carrier sleeve outwardly thereof, said outer sheath consisting essentially of a flexible grade polyester elastomer, fixation of said outer sheath to said carrier sleeve resulting from said outer sheath being overmolded onto said carrier sleeve.

2. A tool handle as claimed in claim 1, further comprising a connecting element fixed to said carrier sleeve inwardly thereof and to be fixed to the tool portion, said connecting element consisting of a plastic that is harder than said material of said carrier sleeve.

3. A tool handle as claimed in claim 2, wherein fixation of said connecting element to said carrier sleeve results from said connecting element being overmolded into said carrier sleeve.

4. A tool handle as claimed in claim 2, wherein said carrier sleeve has at least one outer portion that is not covered by said outer sheath, and said connecting element has an outwardly extending portion fitting over and fixed to said outer portion of said carrier sleeve.

5. A tool handle as claimed in claim 4, wherein said carrier sleeve has opposite end extremity portions that are not covered by said outer sheath, and said connecting element has at opposite ends thereof outwardly extending portions fitting over and fixed to respective said end extremity portions of said carrier sleeve.

6. A tool handle as claimed in claim 2, wherein said connecting element and said carrier sleeve further are fixed to each other by respective complementary interengaging projections and recesses.

7. A tool handle as claimed in claim 1, wherein said carrier sleeve and said outer sheath further are fixed to each other by respective complementary interengaging projections and recesses.

8. A tool handle as claimed in claim 1, wherein said material consists of substantially pure said hard grade polyester elastomer.

9. A tool handle as claimed in claim 1, wherein said outer sheath consists of substantially pure said flexible grade polyester elastomer.

10. A tool comprising a handle-receiving portion and a handle fitted over said handle-receiving portion, said handle comprising:

a carrier sleeve positioned about said handle-receiving portion, said carrier sleeve consisting of a material based on a hard grade polyester elastomer; and an outer sheath fixed to said carrier sleeve outwardly thereof, said outer sheath consisting essentially of a flexible grade polyester elastomer, fixation of said outer sheath to said carrier sleeve resulting from said outer sheath being overmolded onto said carrier sleeve.

11. A tool as claimed in claim 10, further comprising a connecting element fixed to said carrier sleeve inwardly thereof and to be fixed to said handle-receiving portion, said connecting element consisting of a plastic that is harder than said material of said carrier sleeve.

12. A tool as claimed in claim 11, wherein fixation of said connecting element to said carrier sleeve results from said connecting element being overmolded into said carrier sleeve.

13. A tool as claimed in claim 11, wherein said carrier sleeve has at least one outer portion that is not covered by said outer sheath, and said connecting element has an outwardly extending portion fitting over and fixed to said outer portion of said carrier sleeve.

14. A tool as claimed in claim 13, wherein said carrier sleeve has opposite end extremity portions that are not covered by said outer sheath, and said connecting element has at opposite ends thereof outwardly extending portions fitting over and fixed to respective said end extremity portions of said carrier sleeve.

15. A tool as claimed in claim 11, wherein said connecting element and said carrier sleeve further are fixed to each other by respective complementary interengaging projections and recesses.

16. A tool as claimed in claim 10, wherein said connecting element and said handle-receiving portion are fixed to each other by respective complementary interengaging projections and recesses.

17. A tool as claimed in claim 10, wherein said carrier sleeve and said outer sheath further are fixed to each other by respective complementary interengaging projections and recesses.

18. A tool as claimed in claim 10, wherein said material consists of substantially pure said hard grade polyester elastomer.

19. A tool as claimed in claim 10, wherein said outer sheath consists of substantially pure said flexible grade polyester elastomer.

20. A tool as claimed in claim 10, wherein said carrier sleeve is fixed directly to said handle-receiving portion.

21. A tool as claimed in claim 20, wherein said carrier sleeve and said handle-receiving portion are fixed to each other by respective complementary interengaging projections and recesses.

* * * * *